US006786753B1

(12) United States Patent
Lai

(10) Patent No.: US 6,786,753 B1
(45) Date of Patent: Sep. 7, 2004

(54) LOCKING SOCKET STRUCTURE

(76) Inventor: Li-Chun Lai, 21F.-1No.33, Sec.1, Minsheng Rd., Panchiao City, Taipei County (TW)

( * ) Notice: Subject to any disclaimer, the term of this patent is extended or adjusted under 35 U.S.C. 154(b) by 0 days.

(21) Appl. No.: 10/627,661

(22) Filed: Jul. 28, 2003

(51) Int. Cl.[7] ..... H01R 4/50; H01R 13/625
(52) U.S. Cl. ..... 439/346; 439/270
(58) Field of Search ..... 439/346, 270, 439/102, 348, 268, 263

(56) References Cited

U.S. PATENT DOCUMENTS 5,129,836 A * 7/1992 Ursich ..... 439/346
5,286,213 A * 2/1994 Altergott et al. ..... 439/139
5,893,772 A * 4/1999 Carmo et al. ..... 439/346

* cited by examiner

*Primary Examiner*—Hae Moon Hyeon
(74) *Attorney, Agent, or Firm*—Rosenberg, Klein & Lee

(57) ABSTRACT

An improved socket structure comprises essentially a socket, an ellipse-shaped rotation foundation is disposed in the socket, a top is to combine with the top side of the socket and is firmly fixed on the rotation foundation for driving the rotation foundation to rotate; two sides in the socket are respectively configured with a ball, the ball is capable of entering the power jack of the socket; when the electric conduction copper flakes of a plug are inserted into the power jacks of the socket, the top drives the rotation foundation to rotate for generating an angle, then the ball is pushed into the power jacks by the rim of the rotation foundation and lodged in the power jacks into which the electric conduction flakes of the plug are inserted, thus the plug is inseparable from the socket; if the user wants to unplug the plug from the socket, he could just screw the top to make the balls out of the power jacks into which the electric conduction flakes are inserted, and makes it possible to separate the plug from the socket.

8 Claims, 5 Drawing Sheets

LOCKING SOCKET STRUCTURE

FIELD OF THE INVENTION

The invention relates to an improved socket structure, and in particular, to an improved socket structure capable of fixing the plug in the power jack of the socket thereof.

DESCRIPTION OF THE PRIOR ART

Sockets are comprehensively utilized in daily life, as the interface for conduct alternating current, the user only has to plug the plug of electric product into the power jack of the socket, then actuates the electric product for providing convenience and security to people who use electric product everyday. However, conventional socket is not configured with a fixing structure thereon for fixing the plug, making it possible to unplug the plug from the socket by force, such as pull the electric product, thus the electric product is not work anymore because of a power failure, moreover, due to the pulling force, the copper flakes of the plug are deformed, making it impossible to plug the plug into the power jack of the socket. Therefore, it is necessary to design a socket for firmly fixing the plug.

Accordingly, the above-described prior art product is not a perfect design and has still many disadvantages to be solved.

The inventor has notice the various disadvantages associated with the conventional sockets and thought to improve it, and after having carried out an intensive study for many years, has successfully developed the improved socket structure of the invention.

SUMMARY OF THE INVENTION

An object of the invention is to provide an improved socket structure for firmly fixing the plug in the power jack of the socket by engaging the holes of the electric conduction copper flakes of the plug with balls.

Another object of the invention is to provide an improved socket structure characterized in that the user only has to rotate the top to generate an angle for processing the control of fixing and releasing the plug.

Another object of the invention is to provide an improved socket structure is, for example, a simple construction, easily operated by the user, conveniently fabricated by the user and the like.

The improved socket structure as described above essentially comprises a socket, a rotation foundation, two balls, a fixing sleeve, two electric conduction flakes and a top; wherein the front side of the socket is configured with two power jacks, a holding groove is disposed on the top side of said socket, the holding groove interconnects with the power jacks by use of a channel, the channel is a cambered-concave surface for holding the balls, the bottom of the holding groove extends with a orientation shaft, two insertion grooves are disposed on the back side of the socket, the insertion grooves interconnects with the power jacks for inserting the electric conduction flakes; the rotation foundation is a bit ellipse-shaped, the orientation shaft of the holding groove of the socket is inserted into the bottom of the rotation foundation for rotating the rotation foundation in the holding groove; two sides of the bottom of the fixing sleeve respectively extending downward with fixing flakes, the end of the fixing flake is a cambered-concave surface, the center of the bottom of the fixing sleeve is configured with a hole, the fixing sleeve is engaged with the holding groove of the socket, the cambered-concave surface and the channel of the holding groove are combined to form an opening for preventing the balls from entering said holding groove; the top surface of the socket is covered with the top for covering the holding groove of the socket, the fixing pillar extended from the center of the top is inserted into the fixing hole of the rotation foundation, thus, the top is capable of driving the rotation foundation to rotate; when the plug is plugged in the power jacks of the socket, the user rotates the top to generate an angle for driving the rotation foundation to rotate, then the rim of the rotation foundation pushes the balls into the power jacks, and engages with the holes of the electric conduction copper flakes of the plug for fixing the plug; if the user wants to unplug the plug, he just inversely screws the top for a certain angle, thus the balls are free from pushing by the rim of the rotation foundation and hence the plug is released.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
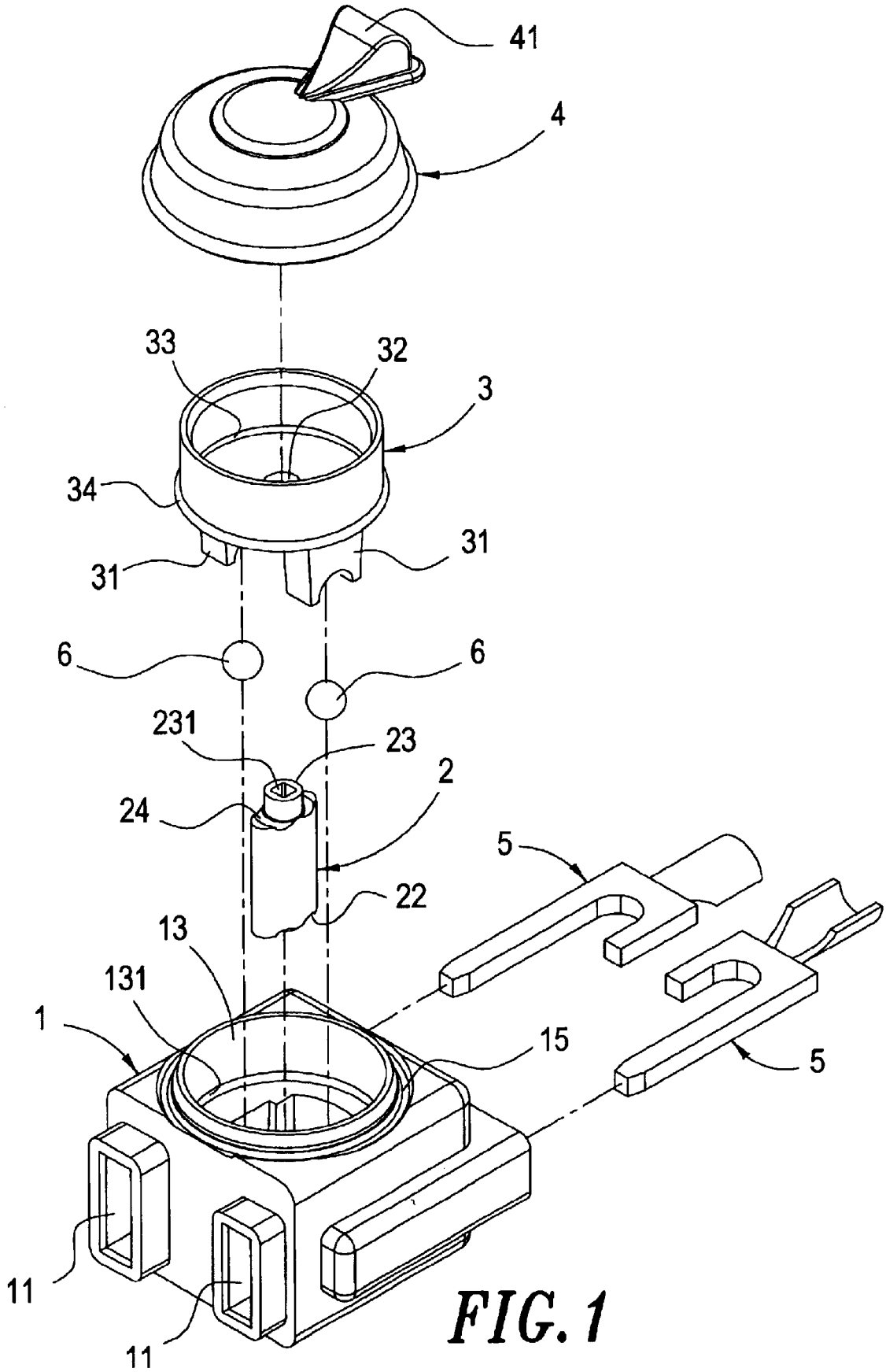
FIG. 1 is an explosion diagram of the improved socket structure according to the invention.
Figure 2A:
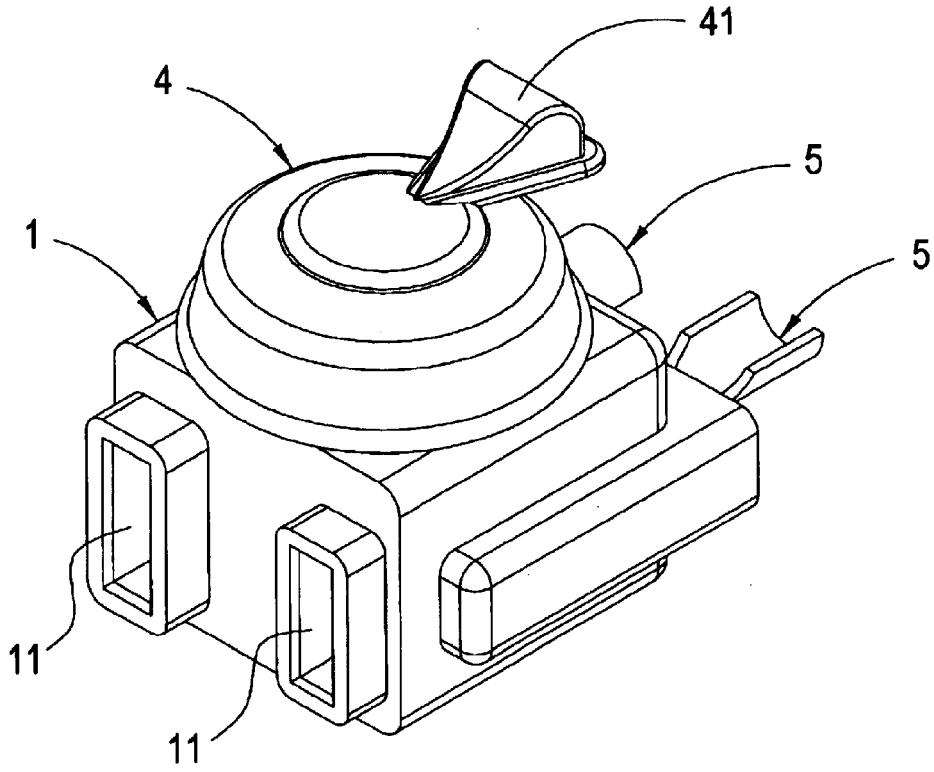
FIGS. 2A, 2B are three-dimensional diagrams of the improved socket structure according to the invention.
Figure 2B:
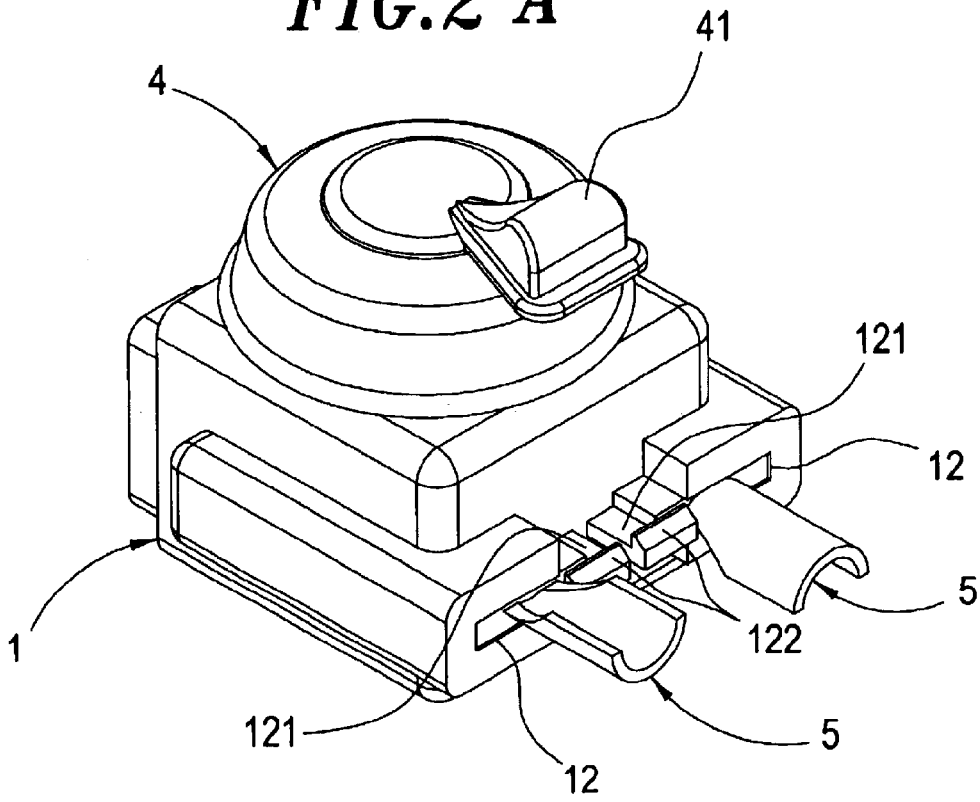
Figure 3A:
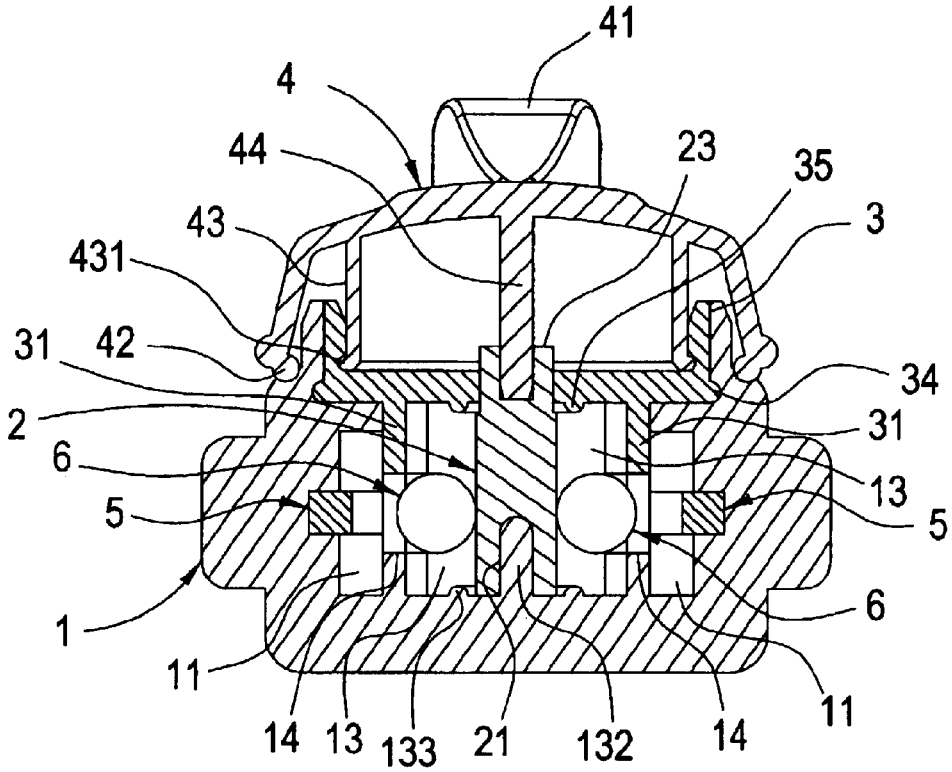
FIGS. 3A, 3B are sectional drawings of the improved socket structure according to the invention.
Figure 3B:
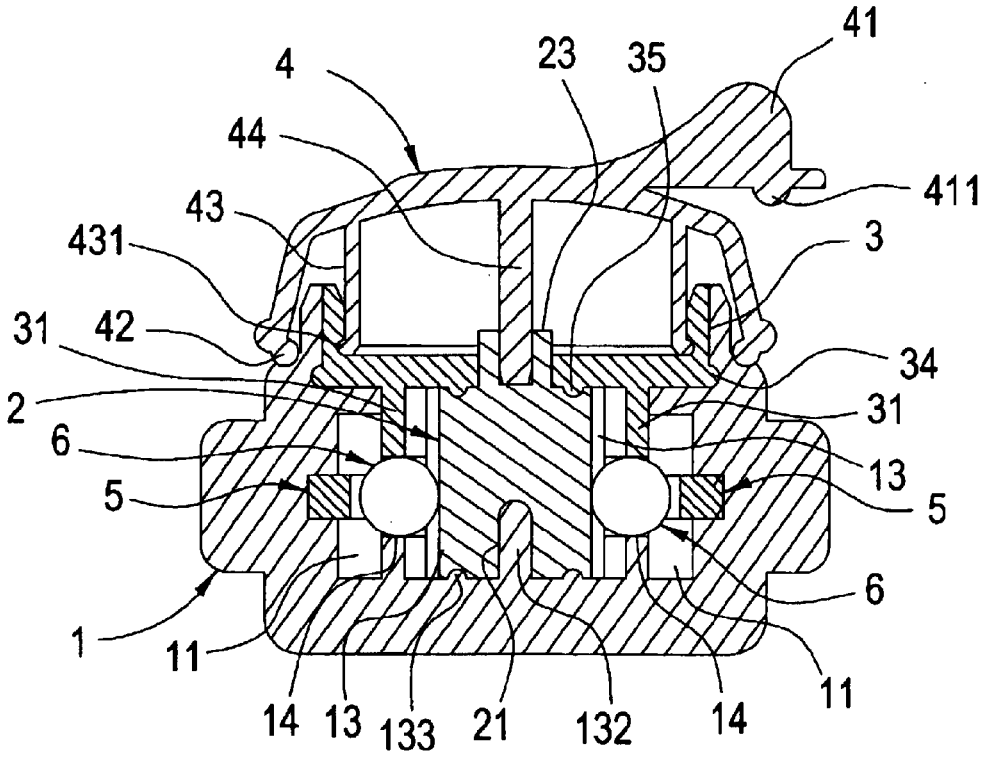

1. Referring to FIG. 1 to FIGS. 3A, 3B, the schematic diagrams an embodiment of the improved socket structure of the invention, the structure essential comprises:

- a socket 1, the front side of the socket 1 is configured with two power jacks 11, an insertion groove 12 interconnected and perpendicular to the power jacks 11 is disposed on the back side of the socket 1, the side of the insertion groove 12 extends with elastic flake 121, the end of the elastic flake 121 is configured with a buckle 122, a holding groove 13 is disposed on the top side of the socket 1, a buckle groove 131 is disposed close to the center of the holding groove 13, a channel 14 interconnected to the power jacks 11 is disposed on the place which is close to the bottom of holding groove 13, the channel 14 is a cambered-concave surface for holding the ball 6, the bottom of the holding groove 13 extends upward with a orientation shaft 132, the fixing protrusion 133 is disposed around the rim of the orientation shaft 132, a sliding groove 15 is disposed around the rim on the surface of the top of the socket 1;
- two electric conduction flakes 5 are respectively inserted the insertion groove 12 disposed on the back side of the socket 1 and then engaged with elastic flake 121 and buckle 122 for fixing the electric conduction flakes 5 in the insertion groove 12 and protruding within the power jacks 11;
- two balls 6 are respectively disposed in channel 14 of the two sides of the socket 1, makes it possible to enter the power jacks 11; the balls 6 can be steel balls, iron balls or balls composed of other material;

a rotation foundation 2, the rotation foundation 2 is a bit ellipse-shaped, a circular hole 21 is disposed on the center of the bottom of the rotation foundation 2, a first groove 22 is disposed around the rim of the circular hole 21, the top of the rotation foundation 2 extends with a protruding pillar 23 configured with a fixing hole 231, a second groove 24 is disposed around the rim of the protruding pillar 23; the orientation shaft 132 of the holding groove 13 is inserted into the circular hole 21 of the bottom of the rotation foundation 2 for engaging the first groove 22 with the fixing protrusion 133, thus the rotation foundation 2 is capable of rotating in the holding groove 13 by using the orientation shaft 132;

a fixing sleeve 3, two sides of the bottom of the fixing sleeve 3 respectively extends downward with two fixing flakes 31 corresponding to each other, the ends of the fixing flakes 31 are cambered-concave surface, and the center of the bottom of the fixing sleeve 3 is configured with a hole 32, a sliding groove 33 is disposed around the inner rim of the hole 32, a buckle 34 is disposed around the outer rim of the hole 32 and a fixing protrusion 35 is disposed around the rim of the bottom of the fixing sleeve 3; the fixing sleeve 3 is engaged with the holding groove 13 of the socket 1, the buckle 34 is engaged with the buckle groove 131 disposed in the center of the holding groove 13, the fixing flakes 31 and the channel 14 of the socket 1 forms an opening for preventing the balls 6 from entering the holding groove 13; the protruding pillar 23 on the top of the rotation foundation 2 entering the fixing sleeve 3 through the hole 32 of the fixing sleeve 3, the second groove 24 disposed on the top is engaged with the fixing protrusion 35 disposed on the bottom of the fixing sleeve 3;

a top 4, the end of the top 4 extends with a handle 41, the rim of the bottom of the handle 41 is configured with a protrusion 411, a first sliding block 42 is disposed around the rim of the top 4, an appropriate place close to the center of the top 4 extends downward with a hollow pillar 43, a second sliding block 431 is configured around the outer rim of the hollow pillar 43 the center of the top 4 extends downward with a fixing pillar 44; the top surface of the socket 1 is covered with the top 4 for inserting the fixing pillar 44 into the fixing hole 231 disposed on the top of the rotation foundation 2, the first sliding block 42 of the outer rim of the top 4 is engaged with the sliding groove 15 of the outer rim of the socket 1, the second sliding block 431 of the outer rim of the hollow pillar 43 is engaged with the sliding groove 33 of the rim on the bottom of the fixing sleeve 3 for rotating the top 4 on the socket 1, thus the top 4 is capable of screwing on the socket 1 and simultaneously driving the rotation foundation 2 to rotate, when the rotation foundation 2 rotates to generate an angle, the rim of the rotation foundation 2 pushes the balls 6 into the power jacks 11, and makes it impossible for the balls 6 to enter the holding groove 13 of the socket 1.

Figure 4A:
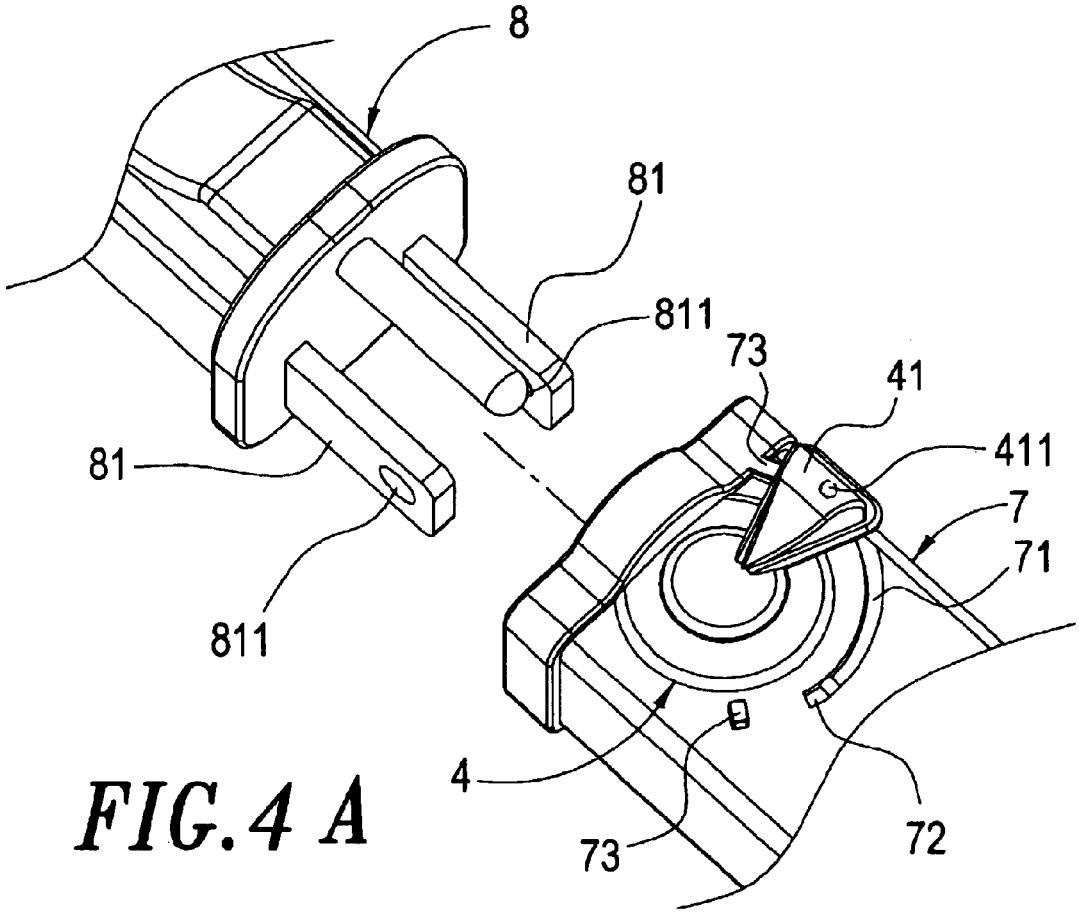
FIGS. 4A, 4B are a schematic diagrams of the embodiment of the improved socket structure according to the invention.
Figure 4B:
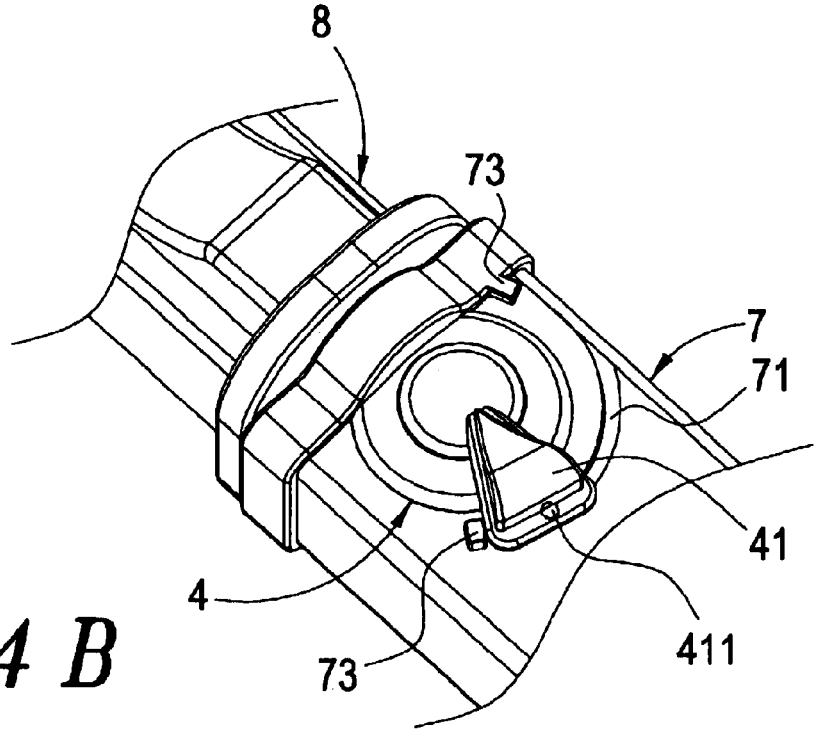
Figure 5A:
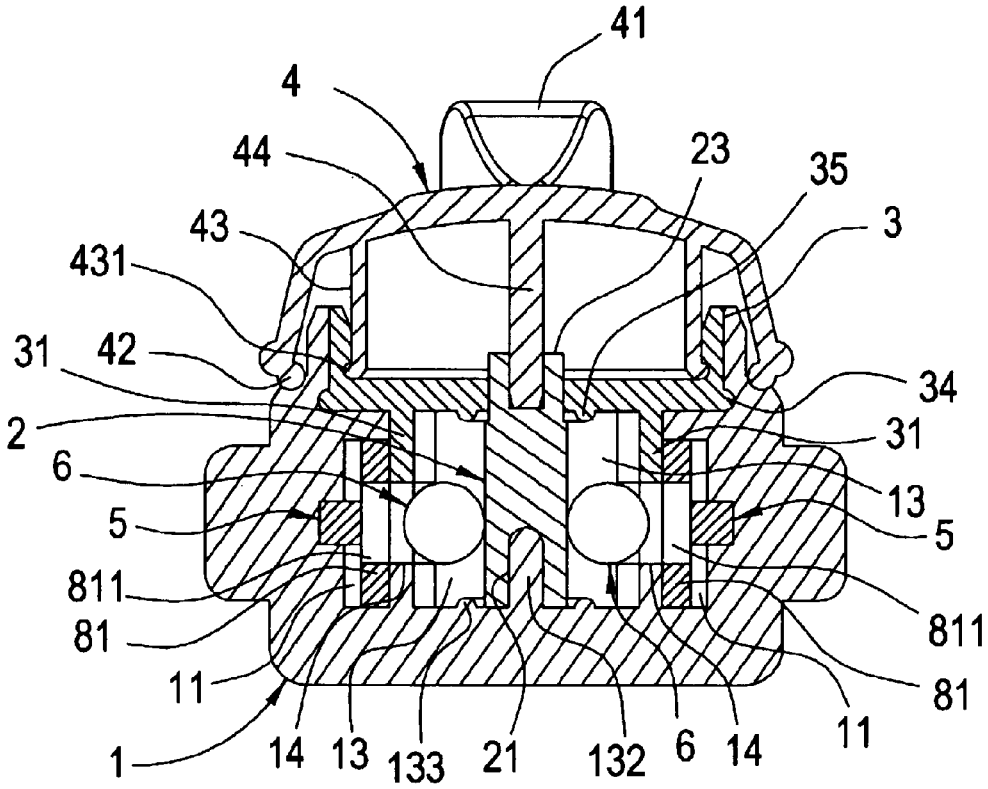
FIGS. 5A, 5B are a schematic diagrams of the embodiment of the improved socket structure according to the invention.
Figure 5B:
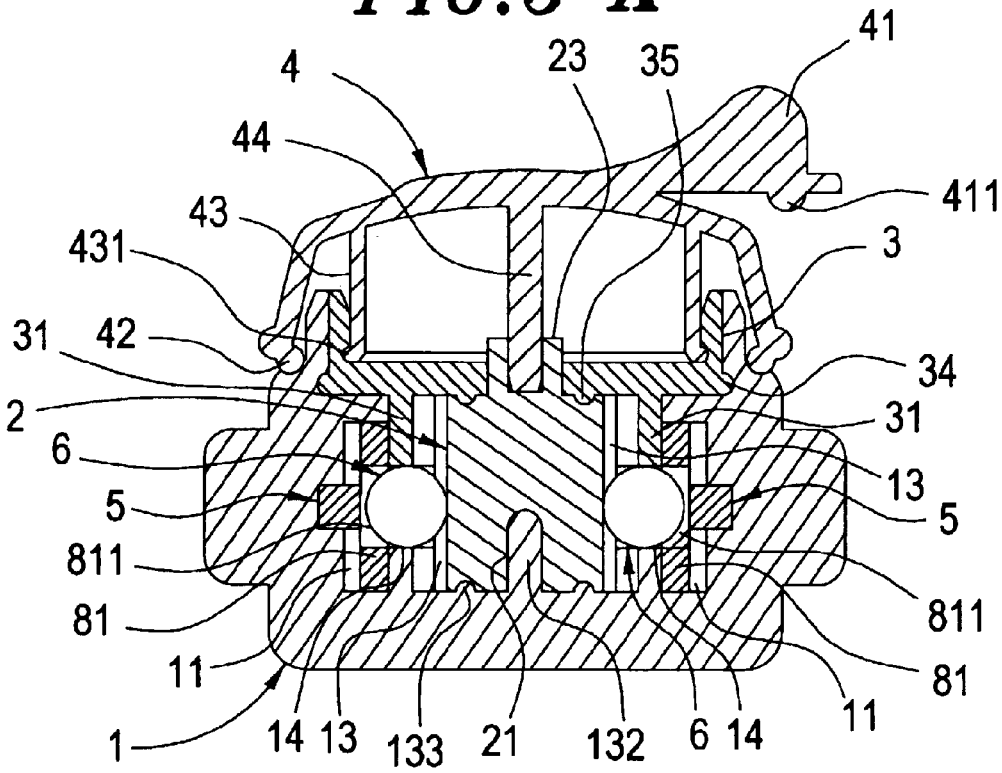

Referring to FIGS. 4A, B and FIGS. 5A, B, are schematic diagrams of the embodiment according to the present invention. The socket 1 is wrapped in a wrapping layer 7, and the top 4 emerges from the top side of the wrapping layer 7, a guiding groove 71 is disposed on the top side of the wrapping layer 7, the end of the guiding groove 71 is configured with a fixing groove 72, two ends of the guiding groove 71 are respectively configured with a block 73 for blocking the top 4 and limiting the top 4 to rotate only between the two blocks 73; when the electric conduction copper flakes 81 of the plug 8 are inserted in the power jacks 11 of the socket 1, the electric conduction copper flakes 81 touches the electric conduction flakes 5, thus electric can be conduct to the electric conduction copper flakes 81; the user can fix the plug 8 by use of the handle 41 to rotate the top to generate an angle and synchronously rotate the rotation foundation 2, in the process of rotating the rotation foundation 2 by the handle 41, a protrusion block 411 disposed on the bottom side of the handle 41 moves along with the guiding groove 71 of the wrapping layer 7 and engage with the fixing groove 7 disposed on the end of the guiding groove 71 for correspondingly fixing the top 4 to the rotation foundation 2, then the rim of the rotation foundation 2 pushes the balls 6 respectively disposed in channel 14 of the two sides of the socket 1 into the power jacks 11 and engages with the holes 811 of the electric conduction copper flakes 81 of the plug 8 for fixing the electric conduction copper flakes 81 of the plug 8 and being inseparable from the power jacks 11; if the user wants to unplug the plug 8, he just inversely screws the top 4 to drive the rotation foundation 2 to rotate, thus the balls 6 are free from pushing by the rim of the rotation foundation 2, hence the electric conduction copper flakes 81 of the plug 8 is separable from the power jacks 11 and the balls 6 are pushed back to the channel 14 of the socket 1.

The improved socket structure provided by the present invention further comprises the following advantages when comparing to the prior art:

1. The present invention utilizes the balls to engage with the holes of the electric conduction copper flakes of the plug for firmly fixing the plug in the power jacks of the socket.
2. The present invention only has to screw the top to generate an angle for processing the control of fixing and releasing the plug.
3. The present invention provides, for example, a simple construction, easily operated by the user, conveniently fabricated by the user and the like.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved socket structure, comprising:

a socket disposing two power jacks on the front side, two insertion grooves interconnected to said power jacks being disposed on the back side of said socket, a holding groove being disposed on the top side of said socket, a channel interconnected to said power jacks being disposed on the two sides close to the bottom of said holding groove, and the bottom of said holding groove extending upward with a orientation shaft;

two electric conduction flakes being respectively inserted into said insertion grooves disposed on the back side of said socket, and protruding within said power jacks;

two balls being respectively disposed in said channel of the two sides of said holding groove, making it possible to enter said power jacks;

a rotation foundation being a bit ellipse-shaped, a circular hole being disposed on the center of the bottom of said rotation foundation, the top of said rotation foundation extending with a protruding pillar configured with a fixing hole; the orientation shaft of said holding groove being inserted into the circular hole of the bottom of said rotation foundation, and said rotation foundation being capable of rotating in said holding groove;

a fixing sleeve, two sides of the bottom of said fixing sleeve respectively extending downward with two fixing flakes corresponding to each other, and the center of the bottom of said fixing sleeve being configured with a hole; said fixing sleeve being engaged with said holding groove of said socket, said fixing flakes and said channel of said holding groove forming an opening for preventing said balls from entering said holding groove; said protruding pillar on the top of said rotation foundation entering said fixing sleeve through the hole of said fixing sleeve;

a top, the end of said top extending with a handle, the center of said top extending downward with a fixing pillar; the top surface of said socket being covered with said top for inserting said fixing pillar into said fixing hole of said rotation foundation, thus, said top being capable of screwing on said socket and driving said rotation foundation to rotate, when said rotation foundation rotates to generate an angle, a rim of said rotation foundation pushes said balls into said power jacks, and makes it impossible for said balls to enter said holding groove of said socket.

2. The improved socket structure according to claim 1, wherein the side of two insertion grooves of said socket respectively extend with an elastic flake, the end of said flake is configured with a buckle used to engage with said electric conduction flakes for firmly fixing said electric conduction flakes in the insertion groove of said socket.

3. The improved socket structure according to claim 1, wherein a sliding groove is disposed around a rim on the surface of the top of said socket, a first sliding block is disposed around a rim of said top, when said top is combined with said socket, said first sliding block is engaged with said sliding groove for rotating said top on said socket.

4. The improved socket structure according to claim 1, wherein a buckle groove is disposed close to the center of said holding groove of said socket, a buckle is disposed around the rim of said fixing sleeve, when said fixing sleeve is combined with said holding groove, said buckle is engaged with said buckle groove for firmly fixing said fixing sleeve in said holding groove.

5. The improved socket structure according to claim 1, wherein the top and the bottom of said rotation foundation respectively disposes a groove around the rim, two corresponding fixing protrusion are respectively disposed around the rim of the bottom of said holding groove and the bottom side of said fixing sleeve for engaging with said groove of said rotation foundation.

6. The improved socket structure according to claim 1, wherein the channel of said socket is a cambered-concave surface, the bottom side of the fixing flake of said fixing sleeve is also a cambered-concave surface, two cambered-concave surfaces are combined to form an opening for preventing said balls from entering said holding groove.

7. The improved socket structure according to claim 1, wherein an appropriate place close to the center of said top extends downward with a hollow pillar, a second sliding block is configured around the outer rim of said hollow pillar, a sliding groove is configured around the inner rim of said fixing sleeve, said second sliding block engages with said sliding groove for fixing and rotating said top.

8. The improved socket structure according to claim 1, wherein said socket is wrapped in a wrapping layer, and said top emerges from the top side of said wrapping layer, a guiding groove is disposed on the top side of said wrapping layer, the end of said guiding groove is configured with a fixing groove, two ends of said guiding groove are respectively configured with a block for blocking said top and limiting said top to rotate only between the two blocks, a protrusion block is disposed on the bottom side of the handle of said top, when said top rotates to a certain position, said protrusion block engages with said fixing groove along said guiding groove for fixing said top.

* * * * *